United States Patent [19]

Fouillout et al.

[11] Patent Number: 4,770,243

[45] Date of Patent: Sep. 13, 1988

[54] DEVICE FOR REGULATING THE RATE OF FLOW OF WATER WHICH IS SEPARATED FROM ITS MIXTURE WITH HYDROCARBONS AND REINJECTED INTO THE BOTTOM OF THE WELL

[75] Inventors: Christian Fouillout, Pau; Daniel Sango, Serres Castet, both of France

[73] Assignee: Societe Nationale Elf Aquitaine (Production), France

[21] Appl. No.: 92,176

[22] Filed: Sep. 2, 1987

[30] Foreign Application Priority Data

Sep. 2, 1986 [FR] France ..... 86 12342

[51] Int. Cl.[4] ..... E21B 43/12; E21B 43/38; E21B 43/40; E21B 47/06

[52] U.S. Cl. ..... 166/53; 166/65.1; 166/106; 166/250; 166/265; 250/301; 405/128

[58] Field of Search ..... 166/250, 53, 65.1, 66, 166/68, 369, 265, 305.1, 106; 250/301; 405/128

[56] References Cited

U.S. PATENT DOCUMENTS

| | | | |
|---|---|---|---|
| 3,066,732 | 12/1962 | McEver | 166/265 X |
| 3,806,727 | 4/1974 | Leonard et al. | 250/301 |
| 3,842,270 | 10/1974 | Gregory | 250/301 |
| 4,019,576 | 4/1977 | Finch | 166/250 |
| 4,296,810 | 10/1981 | Price | 166/265 |
| 4,446,370 | 5/1984 | Gergely | 250/301 |
| 4,649,994 | 3/1987 | Chaudot | 166/68 |

FOREIGN PATENT DOCUMENTS

| | | |
|---|---|---|
| 1213814 | 4/1966 | Fed. Rep. of Germany . |
| 2016175 | 10/1970 | Fed. Rep. of Germany . |

*Primary Examiner*—Stephen J. Novosad

*Attorney, Agent, or Firm*—Ostrolenk, Faber, Gerb & Soffen

[57] ABSTRACT

Production of pertroleum deposits in which water is mixed with the hydrocarbons. The quality of separation is controlled by incorporating within a packer (200) a regulated valve (100) which receives the flow of reinjection water after its separation in a unit (7), the water passing into a fluorescence analyzer (4). The results of the measurement are transmitted to a microprocessor unit (12) which produces a signal which actuates a hydraulic pump (9), which in its turn, actuates the valve (100). Separation of water from the hydrocarbons at the bottom of the well and control of the quality of the separation are effected before the reinjection of the water in a subterranean deposit zone (3).

12 Claims, 3 Drawing Sheets

Figure 1:
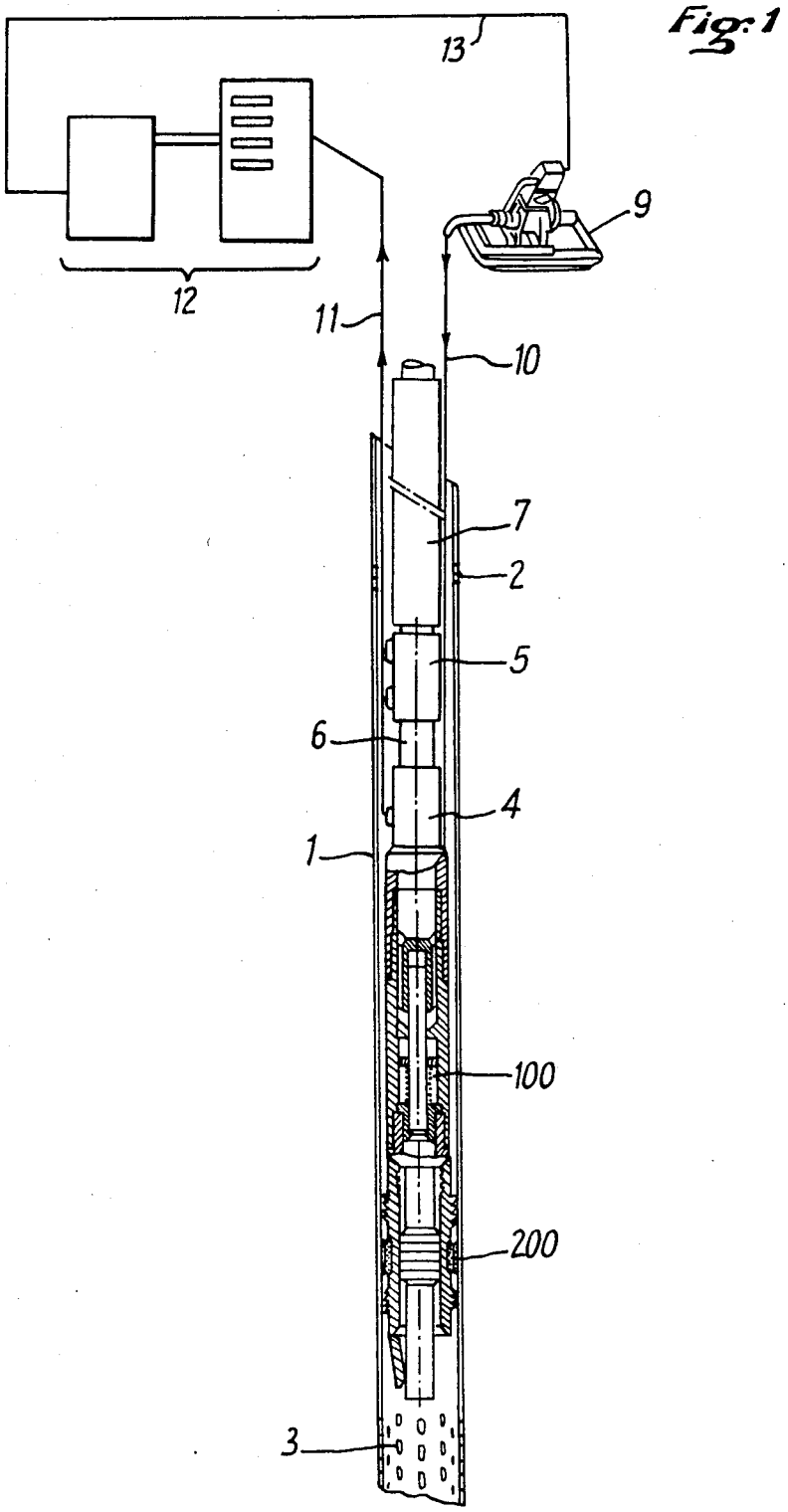

13
9
12
11
10
7
2
5
6
4
1
100
200
3

DEVICE FOR REGULATING THE RATE OF FLOW OF WATER WHICH IS SEPARATED FROM ITS MIXTURE WITH HYDROCARBONS AND REINJECTED INTO THE BOTTOM OF THE WELL

The present invention refers to the field of the production of petroleum from deposits in which the water is mixed with hydrocarbons. The working of such deposits decreases the potential of the well and results in additional production costs.

Customarily, the efflux formed by the mixture of water and hydrocarbons is pumped to the surface and treated by conventional means for the separation of water, the water separated being then reinjected in an underground deposit zone.

The proportion of water may in certain cases amount to 80 to 90% of the total efflux, resulting in an increase in the cost of production and large investments for surface installations.

In accordance with a French patent application filed today by the Applicant, the separation of water and hydrocarbons is effected at the bottom of the well by separation means placed within the production casing and comprising a reinjection pump which, after separation, pumps the water into an underground deposit zone.

However, it has been found important to monitor the degree of separation of water and hydrocarbons in such an installation so as to reinject into the deposit formation only water which contains no trace of hydrocarbons or only a very small, acceptable amount thereof.

The idea which forms the basis of the present invention is to monitor the rate of reinjection by a rate-of-flow regulating device as a function of the quality of the separation of water obtained in the separator.

The device for regulating the rate of flow of the water separated from the mixture of water and hydrocarbons at the bottom of the oil well by separation means arranged within the production casing and comprising a reinjection pump which, after separation, pumps the water into an underground deposit zone in accordance with the invention, is characterized by the fact that said device comprises a valve which is associated with valve-actuating means and forms an integral part of a packer placed in the production casing as well as means of analysis for detecting the presence of hydrocarbons in the water at the outlet of the separator and means for transmitting the results of the analysis to the valve actuating means in the form of electric signals.

In accordance with one preferred embodiment, the analytical means for detecting the presence of hydrocarbons consists of a fluorescence analyzer which is housed within the production casing at the bottom of the well within a sleeve in which the water coming from the separator circulates in the direction towards the valve.

In accordance with a variant, said means of analysis consist of a fluorescence analyzer located at the surface of the well and connected by optical fibers to a detector housed within the production casing at the bottom of the well within a sleeve in which the water coming from the separator flows towards the valve.

Advantageously, the measurement signals coming from the analyzer are transmitted to a microprocessor unit which produces an electric signal which serves for the actuating of the valve.

The flow regulating device preferably includes, in addition to the hydrocarbon detector, a pressure detector and a detector for the rate of flow of separated water, the two detectors being associated with the valve which is integrated in the packer.

In this case, the said detectors can transmit the results of pressure and flow measurements to the microprocessor unit, which unit produces from these signals and from the signal coming from the hydrocarbon detector an electric signal which serves to actuate the valve. The signal thus produced by the microprocessor unit is preferably transmitted to a hydraulic pump which is connected to the valve by a hydraulic fluid conduit.

The valve may suitably be a hydraulic control valve. Preferably the valve comprises a valve body which is fastened to the packer by means of a locator, within which valve body there is mounted a hollow cylindrical tip which leaves an annular passage between the valve body and itself, a jacket is mounted for sliding within a cavity in the valve body and within the hollow of the tip, the lower end of the stationary tip and a shoulder of the valve body forming a port between them, the sliding jacket being provided with another port, an annular shoulder present on the jacket serving as a piston which can slide within the cavity of the valve body, within which there is housed a spring which urges the jacket towards the closing of the port of the valve body, a hydraulic fluid conduit connecting the hydraulic pump on the surface with a chamber of a cylinder-piston unit which (chamber) is formed between the shoulder of the sliding jacket which acts as piston and the annular shoulder of the valve body.

Figure 2:
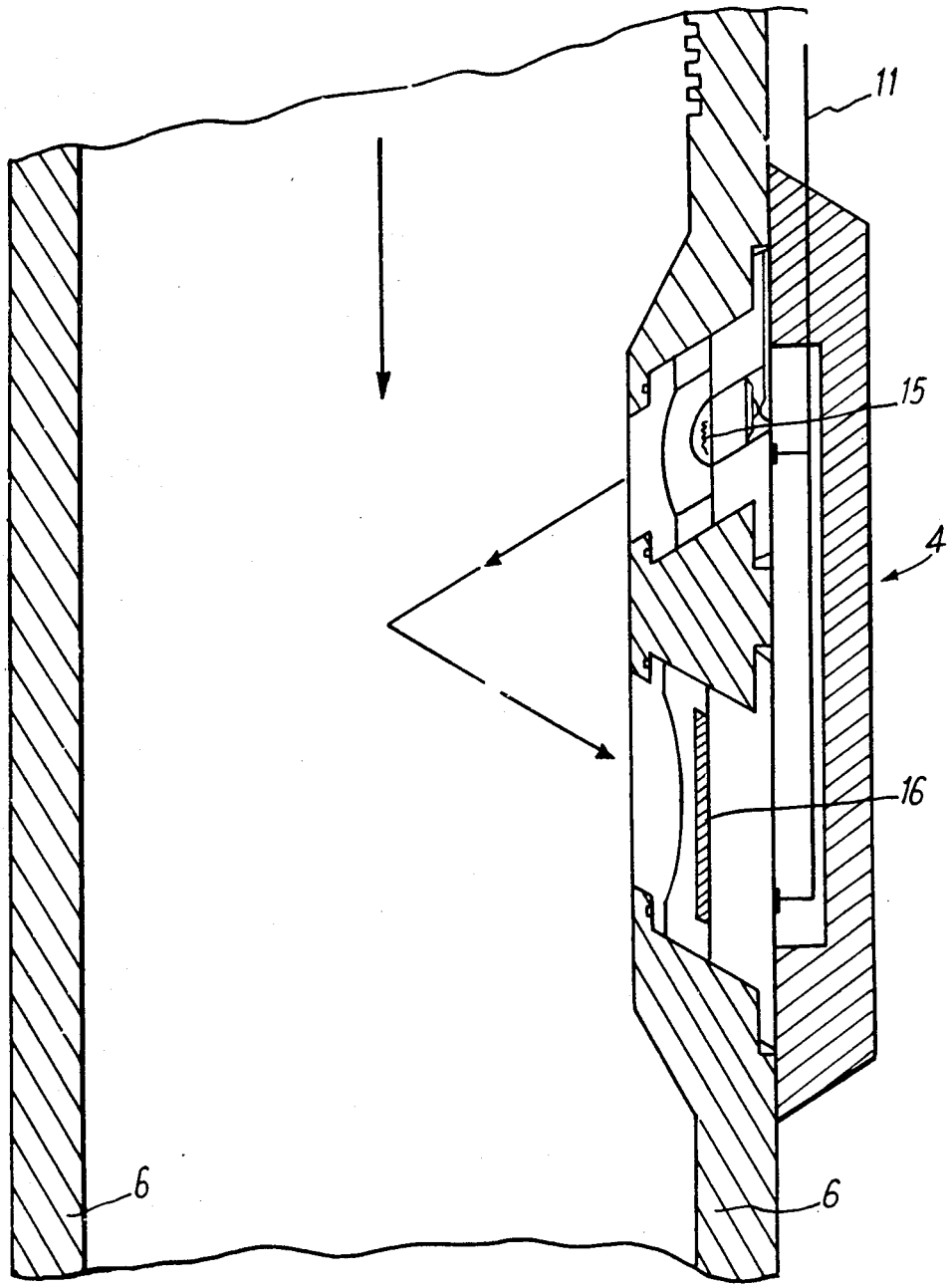
Figure 3:
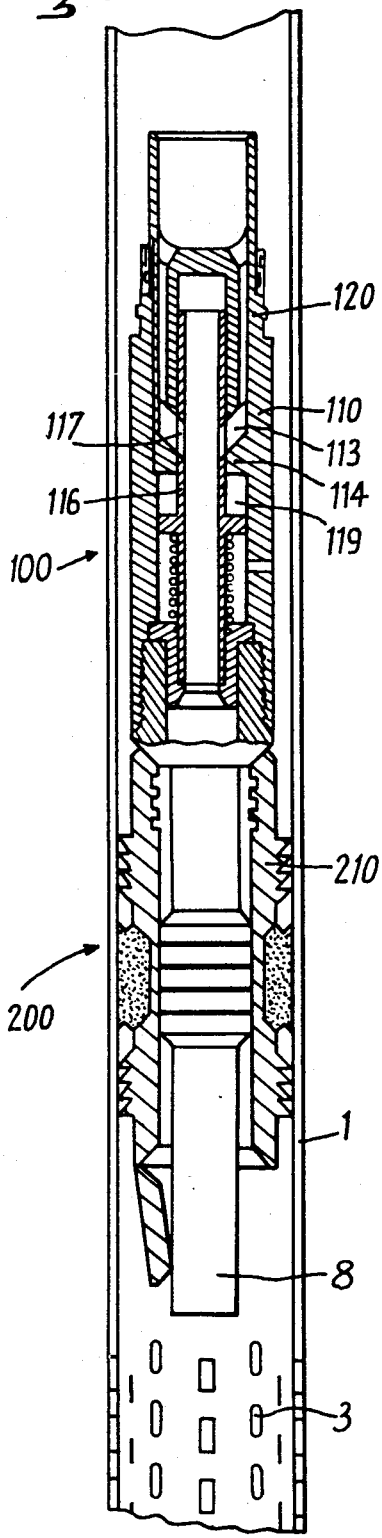
Figure 4:
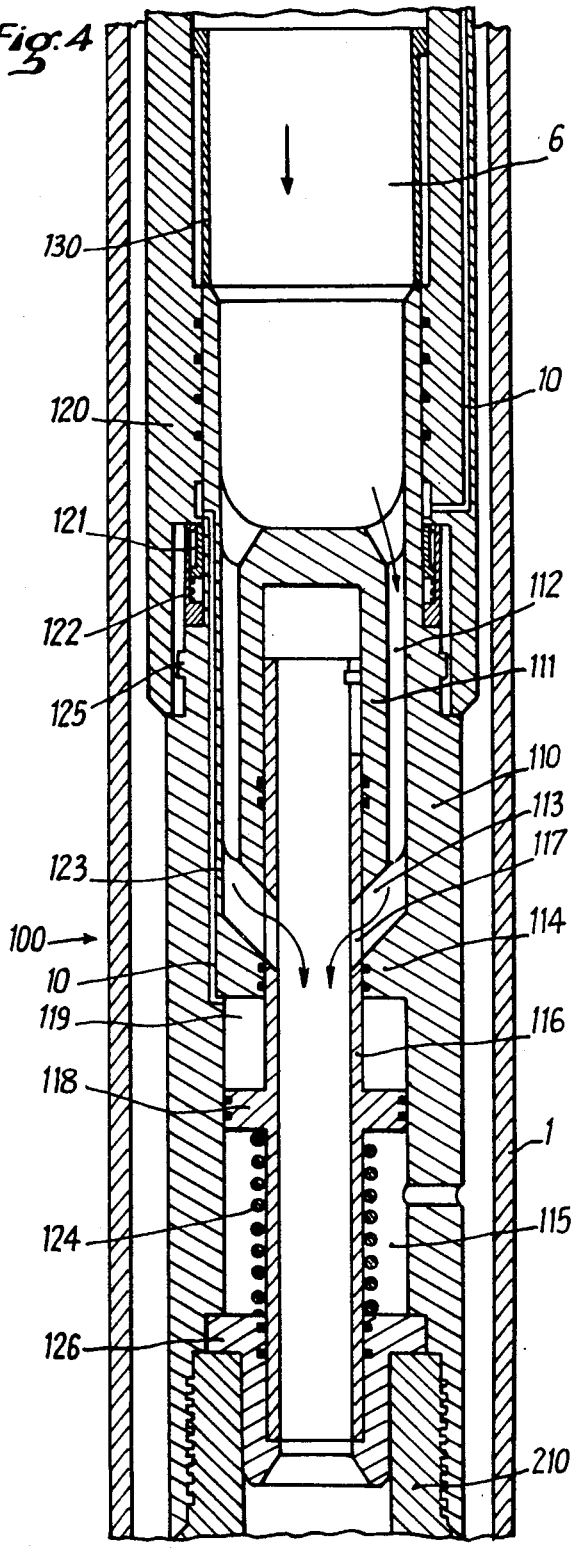

Other features of the invention will become evident from the following non-limitative description of an embodiment of the invention which is illustrated in the drawings, in which FIG. 1 is a diagrammatic view of the device according to the invention, FIG. 2 is a sectional view through the mounting of a transmitter and receiver of the fluorescence oil analyzer, FIG. 3 is an axial sectional view showing the mounting of the valve in the packer, and FIG. 4 is a detailed view in axial section of the valve.

FIG. 1 shows the complete installation for the treating of the efflux from the well, comprising the measuring devices, the valve regulated as a function of these measurements, and a hydraulic pump which actuates the valve. A production casing 1 provided with production-zone perforations 2 and reinjection-zone perforations 3 is in place within a deposit well. A packer 200 traversed by a reinjection tube 8 is placed within the casing 1 and isolates the production zone from the reinjection zone. A regulating valve 100 is fastened on the packer 200 via a locator 210. On the upper body 120 of the valve there are mounted a hydrocarbon detector 4 and a flow and pressure detector 5. These two apparatus are mounted on one or more sleeves 6 within which the water separated from the hydrocarbons in a separation and reinjection unit 7 flows. On the surface a hydraulic pump 9 sends fluid under pressure via conduit 10 to the valve 100. Cables 11 connect the apparatus 4 and 5 to a microprocessor unit 12 serving to decode the signals transmitted by the detectors 4 and 5 and produce the electric signal for the actuating of the hydraulic pump, which signal is transmitted by means of a conductor 13.

In the wall of the sleeve 6 there is housed a fluorescence detector comprising an ultraviolet lamp 15 and a photoelectric receiving cell 16. 11 is a cable which feeds the lamp 15 and connects the receiver 16 to the decoding unit 12 for the transmission of measurement results as to the presence of hydrocarbons in the water flowing in the sleeve 6.

The flow and pressure detector 5 can be a detector of ordinary quality available on the market. The data coming from this detector also pass via the cable 11 to the unit 12.

The valve 100 is integrated in a packer 200 housed in a production casing 1. The lower tip of the valve is screwed into the body of the locator 210 of the packer.

The valve comprises a hollow cylindrical main valve body 110 on which there is force-fitted an upper hollow cylindrical body 120 of the valve. A conduit 10 for the hydraulic fluid coming from the pump 9 at the surface is provided in the upper body 120 and the main body 110. Within the hollow interior of the valve body 110 there is mounted, fastened to the inner walls of the valve body, a hollow cylindrical tip 111 which is closed on its top and has an outside diameter which is smaller than the inside diameter of the valve body, so as to leave an annular passage 112 for the flow of water from the separator 7 towards the valve opening. The port 113 of the valve is formed between the oblique walls of the lower end of the tip 111 and an annular shoulder 114 of the valve body 110.

At its lower part, the valve body 110 has a cylindrical cavity 115 within which there is slidingly housed a jacket 116 the upper part of which penetrates into the cylindrical tip 111.

This jacket is provided with ports 117 and has an annular shoulder 118 acting as piston, within the cavity 115. The part of the cavity 115 present between the piston 118 and the shoulder 114 is formed as a cylinder-piston chamber 119 to which the hydraulic fluid conduit 10 extends.

A spring 124 is mounted between the tip 126 of the valve and the piston 118 to urge the piston upward so that, in the absence of sufficient pressure of hydraulic fluid in the cylinder-piston chamber 119, the sliding jacket 116 is moved upward and the ports 113 and 114, not being opposite each other, the passage of the valve is closed.

Within the valve body 120 and 110 there is mounted another sliding jacket 130 which, upon the descent into the well, assures tightness between the fluid conduit 10 and the outside, so as to avoid the filling of the production casing by the efflux.

Another sliding jacket 121 provided with spring 122 is placed at the junction by force-fitting, of the main valve body 110 and the upper valve body 120, so as to assure, upon the descent of the valve in the well, tightness between the cylinder-piston chamber 119 and the outside. It is retractable upon mounting, while the spring 122 makes it possible to reestablish the tightness between the chamber 119 and the outside.

Studs 125 on the outer wall of the main valve body 110 on the inside of its junction with the upper body 120 permit the placing and fishing of the valve in the bottom of the well.

In order to prepare for the placing in operation of the installation, it is necessary to establish a program for the microprocessor unit 12. This programming is based on the specification values which are specifically established. In order to do this, one determines a law of variation of the degree of opening and closing of the valve as a function of the oil content in p.p.m. detected by the analyzer and as a function either of the rate of flow or of the pressure of flow of the reinjected water. One can, for instance, fix a flow of constant pressure, the rate of flow having to vary automatically in order to retain this pressure value. Likewise one can fix several critical values of the hydrocarbon content in the reinjection water; to each value thus selected there corresponds a certain degree of opening or closing of the valve. By further constricting the passage through the valve 110, one can, in case of separation by centrifuging, prolong the stay of the water-hydrocarbon mixture in the separator in order to obtain greater purity of the water and therefore a hetter quality of the separation.

The invention is not limited to the embodiment described; it is capable of numerous variations within the scope of the man skilled in the art. Thus, in order to reduce to a minimum the space taken up by measuring instruments in the bottom of the well, the ultra-violet beam can be transmitted from the surface by means of optical fibers and focused on the water to be analyzed; the fluorescence will thus he detected by other optical fibers and transmitted to the surface. In this case, all the devices for the transmission and reception of the luminous signal are arranged on the surface.

We claim:

1. A device for regulating the rate of flow of water which is separated from its mixture with the hydrocarbons at the bottom of an oil well by means of separation arranged within the production casing (1) and comprising a reinjection pump which, after separation, pumps the water into an underground deposit zone (3), characterized by the fact that said device comprises a valve (100) associated with valve actuating means (9) and forming an integral part of a packer (200) arranged in the production casing, analysis means (4) for detecting the presence of hydrocarbons in the water at the outlet of the separator (7), and means for transmitting the results of the analysis to the valve actuating means (9) in the form of electric signals.

2. A device according to claim 1, characterized by the fact that the analysis means (4) for detecting the presence of hydrocarbons are formed of a fluorescence analyzer (15,16) which is housed within the production casing at the bottom of the well within a sleeve (6) in which the water coming from the separator (7) flows in the direction towards the valve (100).

3. A device according to claim 1, characterized by the fact that the analysis means (4) for detecting the presence of hydrocarbons consist of a fluorescence analyzer located at the surface of the well and connected by optical fibers to a detector housed within the production casing at the bottom of the well within a sleeve in which the water coming from the separator flows in the direction towards the valve.

4. A device according to claim 1, characterized by the fact that the measurement signals coming from the analyzer are transmitted to a microprocessor unit (12) which produces an electric signal serving for the actuating of the valve.

5. A device according to claim 1, characterized by the fact that the device for regulating the rate of flow of separated water comprises, in addition to the hydrocarbon detector, a pressure detector and a detector (5) for the rate of flow of separated water intended to be reinjected, the two detectors being associated with the valve integrated in the packer.

6. A device according to claim 5, characterized by the fact that the said detectors transmit results of pressure and flow measurements to the microprocessor unit (12) which, from these signals and from the signal coming from the hydrocarbon detector produces an electric signal serving for the actuating of the valve.

7. A device according to claim 4, characterized by the fact that the signal thus produced by the microprocessor unit is transmitted to a hydraulic pump which is connected by a hydraulic fluid conduit to the valve.

8. A device according to claim 1, characterized by the fact that the valve comprises a valve body (110) fastened by means of a locator (210) to the packer (200), in the interior of which valve body (110) there is mounted a hollow cylindrical tip (111) leaving an annular passage between the valve body and itself, a jacket (116) being slidingly mounted within a cavity (115) in the valve body and within the hollow of the tip (111), the lower end of the fixed tip (111) and the shoulder of the valve body (110) forming a port (113) between them, the sliding jacket (116) being provided with another port (117), an annular shoulder (118) of the jacket (116) serving as piston capable of sliding within the cavity (115) of the valve body, within which there is housed a spring (124) which urges the jacket towards the closing of the port (113) of the valve body, a hydraulic fluid conduit (10) connecting the hydraulic pump on the surface with a cylinder-pump chamber (119) formed between the shoulder of the jacket (118) acting as piston and the annular shoulder (114) of the valve body (110).

9. A device according to claim 2, characterized by the fact that the measurement signals coming from the analyzer are transmitted to a microprocessor unit which produces an electric signal serving for the actuating of the valve.

10. A device according to claim 3, characterized by the fact that the measurement signals coming from the analyzer are transmitted to a microprocessor unit which produces an electric signal serving for the actuating of the valve.

11. A device according to claim 5, characterized by the fact that the signal thus produced by the microprocessor unit is transmitted to a hydraulic pump which is connected by a hydraulic fluid conduit to the valve.

12. A device according to claim 6, characterized by the fact that the signal thus produced by the microprocessor unit is transmitted to a hydraulic pump which is connected by a hydraulic fluid conduit to the valve.

* * * * *